US006457551B1

(12) United States Patent
Chang

(10) Patent No.: US 6,457,551 B1
(45) Date of Patent: Oct. 1, 2002

(54) REPLACEABLE MUFFLER STRUCTURE WITH AN ADJUSTABLE LENGTH

(75) Inventor: Ming-Tien Chang, Fen-Yuan Hsiang (TW)

(73) Assignee: Liang Fei Industry Co., Ltd., Fen-Yuan Hsiang (TW)

( * ) Notice: Subject to any disclaimer, the term of this patent is extended or adjusted under 35 U.S.C. 154(b) by 157 days.

(21) Appl. No.: 09/613,758

(22) Filed: Jul. 11, 2000

(51) Int. Cl.[7] ..... F01N 7/18
(52) U.S. Cl. ..... 181/243; 181/242
(58) Field of Search ..... 181/243, 242, 181/211, 212, 214, 224, 229, 232, 244

(56) References Cited

U.S. PATENT DOCUMENTS 4,537,278 A * 8/1985 Okada et al. ..... 181/277
4,693,339 A * 9/1987 Beale et al. ..... 181/255

* cited by examiner

*Primary Examiner*—Robert E. Nappi
*Assistant Examiner*—Kim Lockett
(74) *Attorney, Agent, or Firm*—Rosenberg, Klein & Lee

(57) ABSTRACT

A replaceable muffler structure with an adjustable length includes a muffler, a tail pipe having a rear end provided with an insertion section movably mounted in a rear end of the muffler, and a positioning ring mounted on the rear end of the muffler for locking the insertion section of the rear end of the tail pipe. The rear end of the muffler has an air outlet provided with an annular flange for receiving the insertion section of the rear end of the tail pipe. The positioning ring is provided with a fitting portion fitted on the annular flange of the muffler and defines a plurality of screw holes. A plurality of bolts are each screwed into a corresponding one of the screw holes, and each urged on an outer periphery of the insertion section of the rear end of the tail pipe. A plurality of nuts are each screwed on a corresponding one of the bolts.

2 Claims, 6 Drawing Sheets

REPLACEABLE MUFFLER STRUCTURE WITH AN ADJUSTABLE LENGTH

BACKGROUND OF THE INVENTION

1. Field of the Invention

The present invention relates to a replaceable muffler structure with an adjustable length.

2. Description of the Related Art

A conventional muffler structure in accordance with the prior art comprises a muffler having a rear end secured to a tail pipe by a soldering or brazing process. However, the conventional muffler structure cannot be used to mate with tail pipes different kinds of cars due to the muffler being soldered or brazed to the tail pipe so that the manufacturer and the fitting factory have to fabricate and store mufflers of different regulations and sizes to mate with tail pipes of various kinds of cars so as to fit the requirements of different kinds of cars, thereby greatly increasing the cost of fabrication.

SUMMARY OF THE INVENTION

In accordance with one aspect of the present invention, there is provided a replaceable muffler structure with an adjustable length comprising: a muffler, a tail pipe having a rear end provided with an insertion section movably mounted in a rear end of the muffler, and a positioning ring mounted on the rear end of the muffler for locking the insertion section of the rear end of the tail pipe, wherein,

- the rear end of the muffler has an air outlet provided with an annular flange for receiving the insertion section of the rear end of the tail pipe;
- the positioning ring is provided with a fitting portion fitted on the annular flange of the muffler and defines a plurality of screw holes;
- a plurality of bolts are each screwed into a corresponding one of the screw holes, and each urged on an outer periphery of the insertion section of the rear end of the tail pipe; and
- a plurality of nuts are each screwed on a corresponding one of the bolts.

In accordance with another aspect of the present invention, the muffler includes two tubes mounted therein, each of the two tubes has a distal end provided with an annular flange for receiving an insertion section of a rear end of a tail pipe and for mounting a positioning ring.

Further benefits and advantages of the present invention will become apparent after a careful reading of the detailed description with appropriate reference to the accompanying drawings.

DETAILED DESCRIPTION OF THE INVENTION

Figure 1:
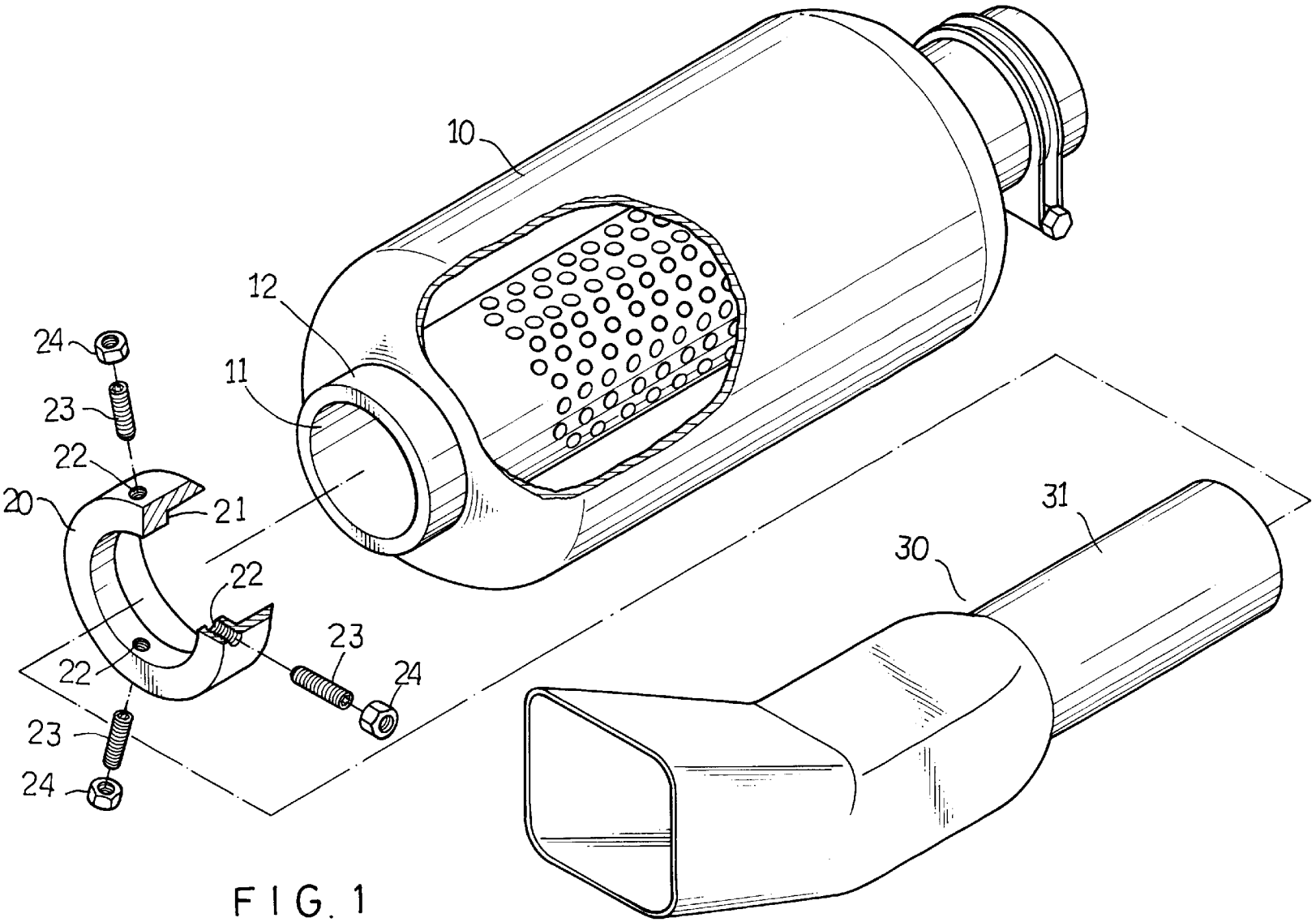
FIG. 1 is an exploded view of a replaceable muffler structure with an adjustable length in accordance with the present invention.
Figure 2:
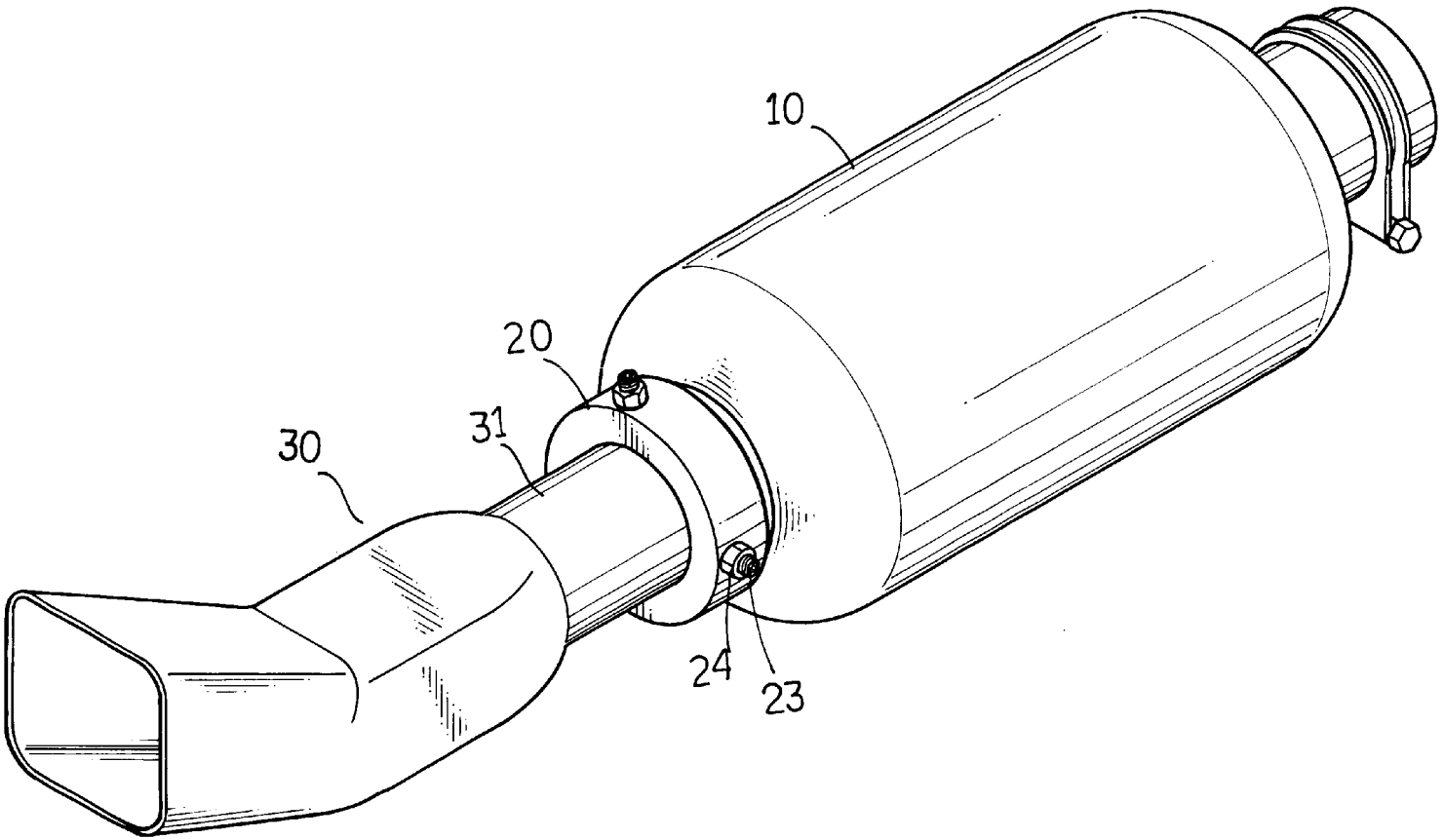
FIG. 2 is a perspective assembly view of the replaceable muffler structure with an adjustable length as shown in FIG. 1.
Figure 3:
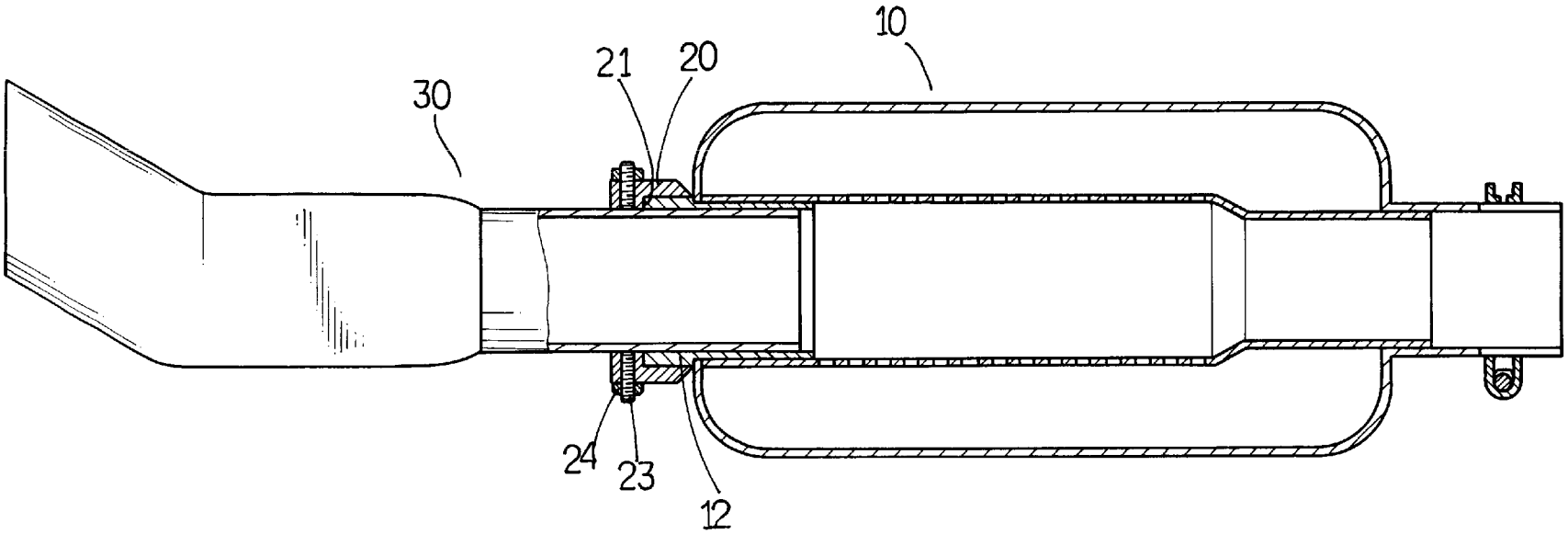
FIG. 3 is a front plan cross-sectional assembly view of the replaceable muffler structure with an adjustable length as shown in FIG. 1.

Referring to the drawings and initially to FIGS. 1–3, a replaceable muffler structure with an adjustable length in accordance with the present invention comprises a muffler 10, a tail pipe 30 having a rear end provided with an insertion section 31 movably mounted in a rear end of the muffler 10, and a positioning ring 20 mounted on the rear end of the muffler 10 for locking the insertion section 31 of the rear end of the tail pipe 30.

The rear end of the muffler 10 has an air outlet 11 provided with an annular flange 12 for receiving the insertion section 31 of the rear end of the tail pipe 30 therein.

The positioning ring 20 includes an inner wall provided with a fitting portion 21 securely fitted on the annular flange 12 of the muffler 10, and the positioning ring 20 also defines a plurality of screw holes 22 connecting to the insertion section 31 of the rear end of the tail pipe 30.

A plurality of bolts 23 are each screwed into a corresponding one of the screw holes 22 of the positioning ring 20, and are each urged on an outer periphery of the insertion section 31 of the rear end of the tail pipe 30. A plurality of nuts 24 are each screwed on a corresponding one of the bolts 23 to co-operate with the respective bolt 23.

In assembly, referring to FIGS. 1–4, the positioning ring 20 is initially mounted on the rear end of the muffler 10 with the annular flange 12 of the muffler 10 being securely fitted into the fitting portion 21 of the positioning ring 20. The insertion section 31 of the rear end of the tail pipe 30 is then inserted into the positioning ring 20 and then into the muffler 10 through the air outlet 11. The insertion section 31 of the rear end of the tail pipe 30 can be moved in the muffle 10 so as to adjust the exposing length of the insertion section 31 of the rear end of the tail pipe 30 relative to the muffler 10.

Figure 4:
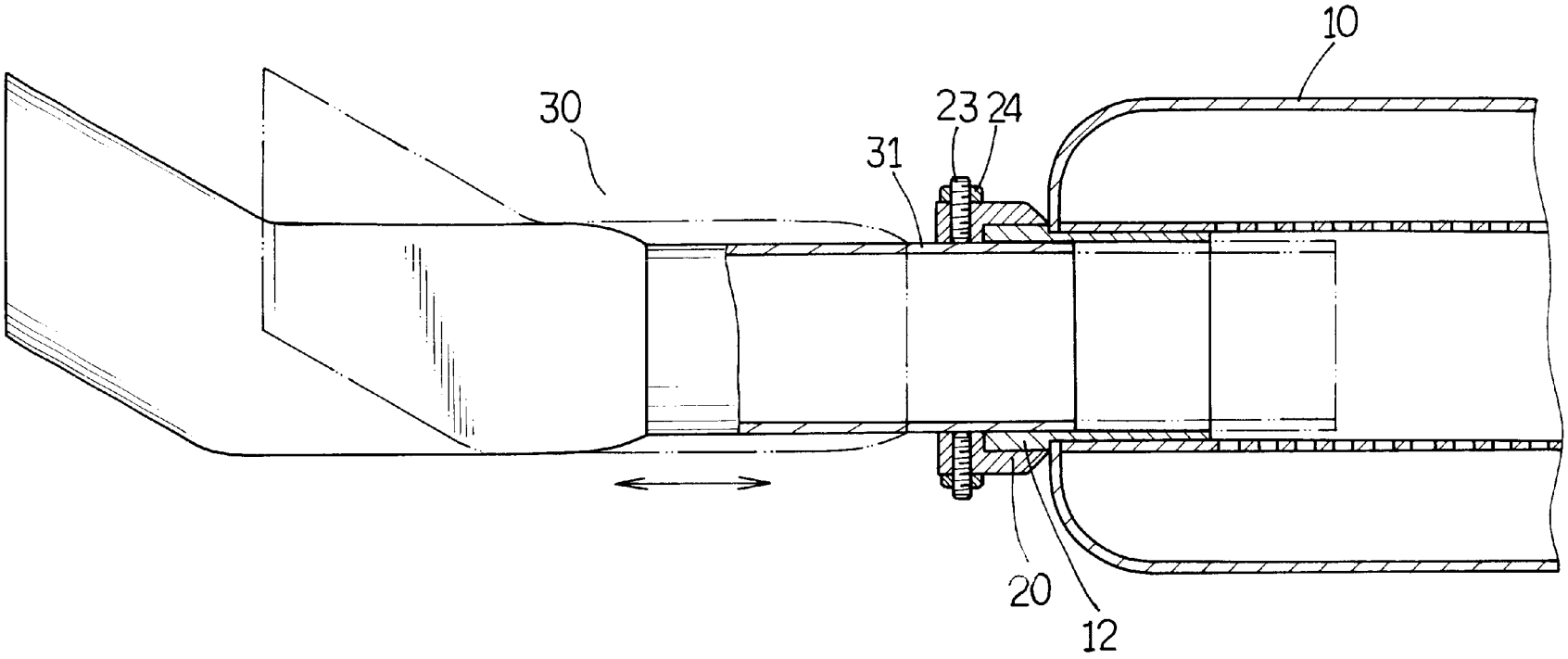
FIG. 4 is an operational view of the replaceable muffler structure with an adjustable length as shown in FIG. 3.

When the length of the tail pipe 30 is adjusted to a desired extent as shown in FIG. 4, each of the bolts 23 co-operating with the respective nut 24 is screwed into the respective screw hole 22 of the positioning ring 20 to be urged on the outer periphery of the insertion section 31 of the rear end of the tail pipe 30, thereby securing the insertion section 31 of the rear end of the tail pipe 30 in the positioning ring 20 so that the tail pipe 30 is locked to the muffler 10, thereby assembling the parts as shown in FIG. 1 into an exhaust pipe with the replaceable muffler structure as shown in FIG. 2.

In addition, the insertion section 31 of the rear end of the tail pipe 30 is adjustably secured to the muffler 10 by the positioning ring 20 so that the insertion section 31 of the rear end of the tail pipe 30 can be properly rotated in the muffler 10 so as to adjust a proper angle according to the requirements of different kinds of vehicles.

Further, the insertion section 31 of the rear end of the tail pipe 30 is detachably mounted to the rear end of the muffler 10 so that the muffler 10 can be adapted to fit different tail pipes of various kinds of vehicles according to the requirements of the consumers.

Accordingly, the replaceable muffler structure in accordance with the present invention can be used to adjust proper lengths and angles so as to mate with different kinds of vehicles so that it is unnecessary to produce mufflers of various regulations and sizes so as to fit the requirements of the consumers, thereby greatly saving the cost of fabrication.

In addition, the muffler 10 can be replaced when it is worn out without having to replace the entire tail pipe 30.

Figure 5:
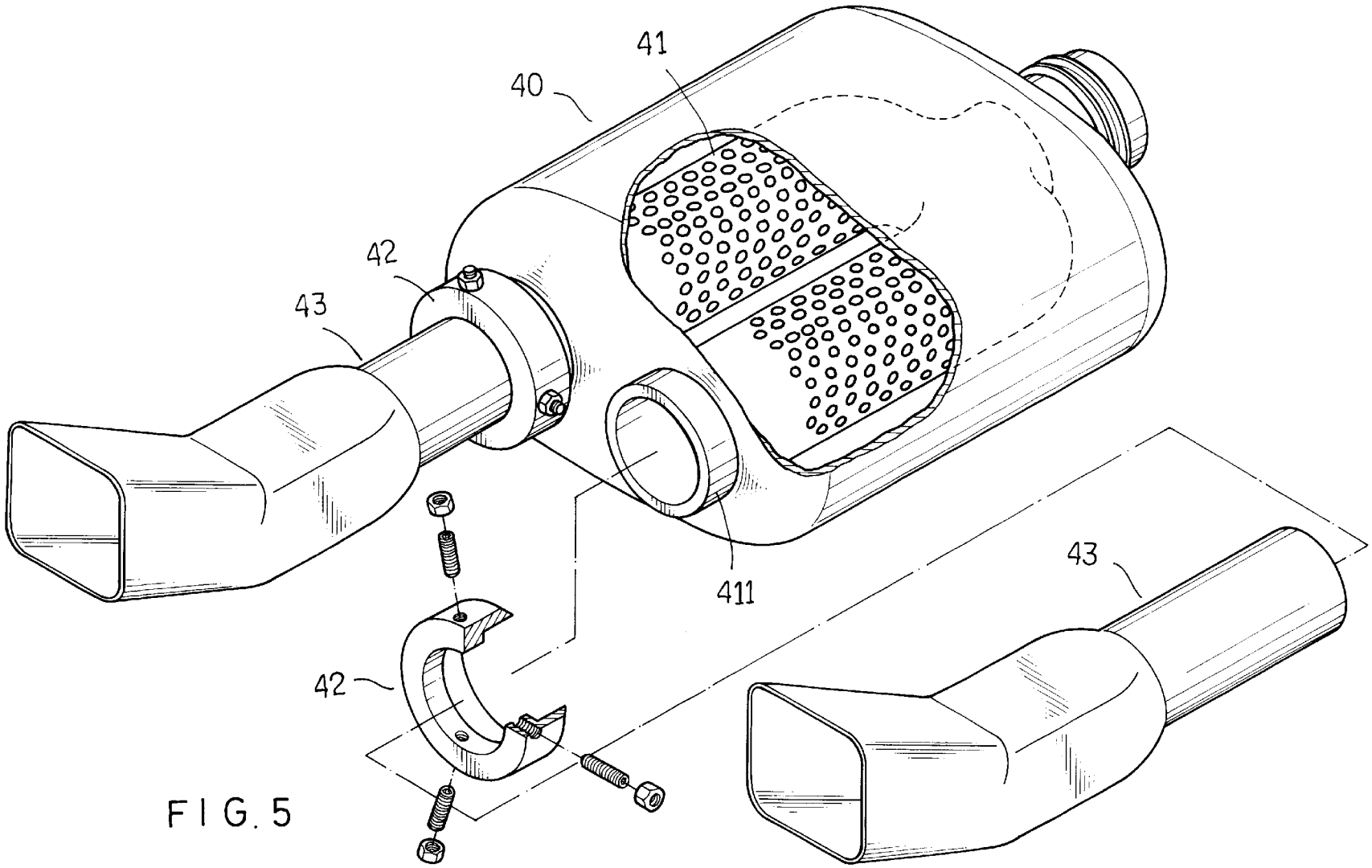
FIG. 5 is an exploded view of a replaceable muffler structure with an adjustable length in accordance with another embodiment of the present invention.
Figure 6:
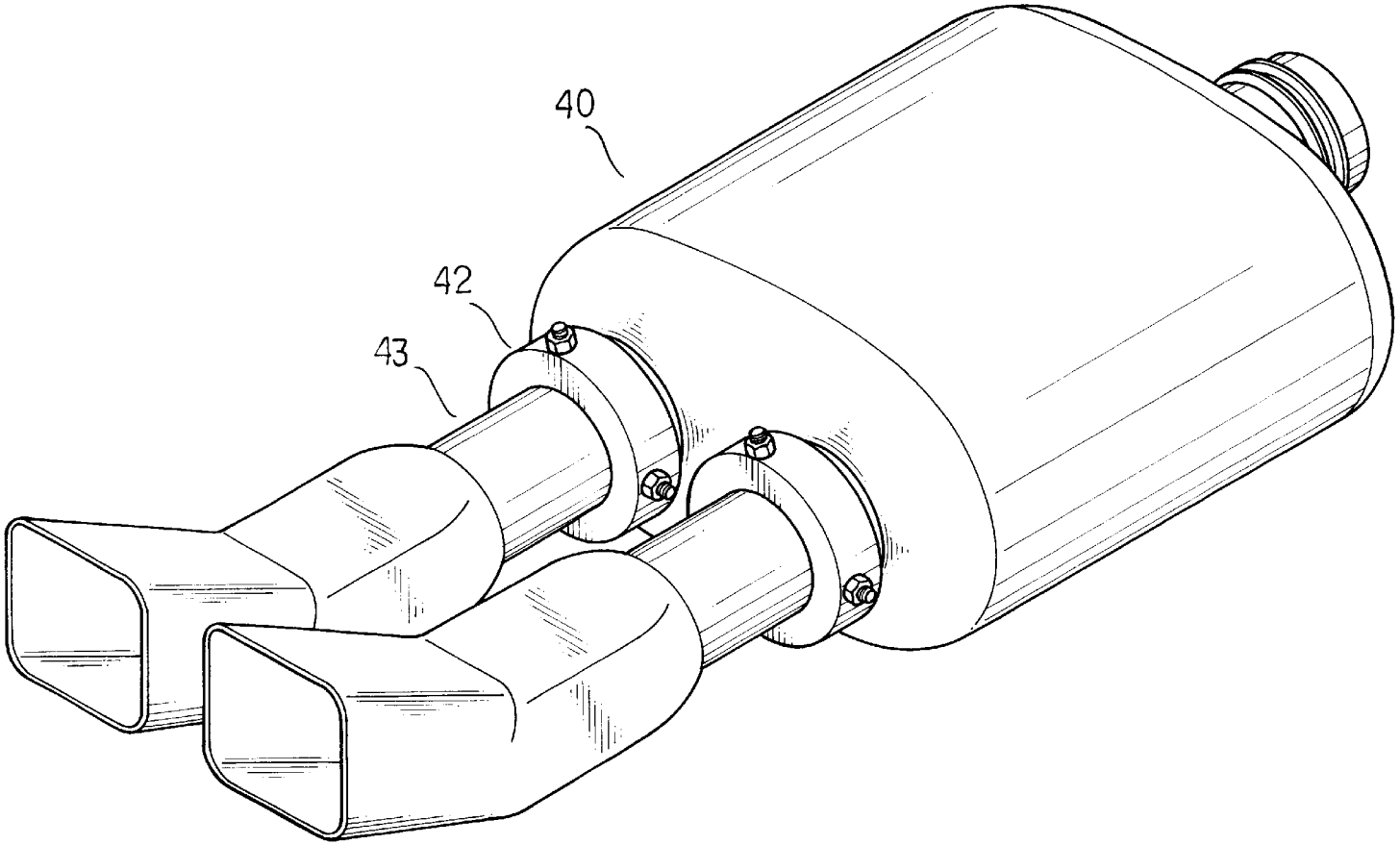
FIG. 6 is a perspective assembly view of the replaceable muffler structure with an adjustable length as shown in FIG. 5.

Referring to FIGS. 5 and 6, in accordance with another embodiment of the present invention, the muffler 40 includes a bifurcated pipe having two tubes 41 mounted therein. Each of the two tubes 41 has a distal end provided with an annular flange 411 for receiving an insertion section of a rear end of a tail pipe 43 and for mounting a positioning ring 42.

It should be clear to those skilled in the art that further embodiments may be made without departing from the scope of the present invention.

What is claimed is:

1. A replaceable muffler structure with an adjustable length, comprising:

a muffler having at least one outlet, said at least one outlet having a passage extending longitudinally from an interior portion of said muffler, said at least one outlet having a flange formed on a distal end thereof;

at least one positioning ring secured to said flange of said at least one outlet, said at least one positioning ring having a longitudinally extended bore disposed in coaxial alignment with said passage, said at least one positioning ring having a plurality of radially directed threaded openings formed therethrough in angularly spaced relationship and in open communication with said bore;

at least one tail pipe adjustably secured to said muffler, said at least one tail pipe having a longitudinally extended insertion section formed on a first end thereof telescopically disposed in said bore of said at least one positioning ring and said passage of said outlet to provide an adjustable length between a second end thereof and said muffler; and, a plurality of bolts respectively threadedly engaged with said plurality of radially directed threaded openings, said plurality of bolts being extended into said bore to contact said insertion section of said tail pipe for securement thereof.

2. A replaceable muffler structure with an adjustable length, comprising:

a muffler having a pair of outlets, each of said outlets having a passage extending longitudinally from an interior portion of said muffler, each of said outlets having a flange formed on a distal end thereof;

a pair of positioning rings, each of said pair of positioning rings being secured to said flange of a respective one of said outlets, each of said positioning rings having a longitudinally extended bore disposed in coaxial alignment with said passage of a respective on of said outlets and a plurality of radially directed threaded openings formed therethrough in angularly spaced relationship and in open communication with said bore;

a pair of tail pipes respectively adjustably secured to said muffler, each of said tail pipes having a longitudinally extended insertion section formed on a first end thereof telescopically disposed in said bore of a respective one of said positioning rings and said passage of a corresponding one of said outlets to provide an adjustable length between a second end of said tail pipe and said muffler; and, a plurality of bolts respectively threadedly engaged with said plurality of radially directed threaded openings of each of said pair of positioning rings, a portion of said plurality of bolts respectively associated with each of said positioning rings being extended into said bore thereof to contact a respective insertion section of a corresponding one of said tail pipes for securement thereof.

* * * * *